US007143461B2

(12) United States Patent
Spooner

(10) Patent No.: US 7,143,461 B2
(45) Date of Patent: Dec. 5, 2006

(54) SWEEPING APPLIANCE

(75) Inventor: Gregory Clegg Spooner, Hong Kong (HK)

(73) Assignee: Hayco Manufacturing Limited, Causeway Bay (HK)

( * ) Notice: Subject to any disclaimer, the term of this patent is extended or adjusted under 35 U.S.C. 154(b) by 222 days.

(21) Appl. No.: 10/664,579

(22) Filed: Sep. 17, 2003

(65) Prior Publication Data

US 2005/0055785 A1 Mar. 17, 2005

(51) Int. Cl.
*A47L 11/33* (2006.01)

(52) U.S. Cl. ..... 15/41.1

(58) Field of Classification Search ..... 15/41.1, 15/42, 46

See application file for complete search history.

(56) References Cited

U.S. PATENT DOCUMENTS 4,031,659 A * 6/1977 Keller et al. ..... 446/427
4,262,443 A * 4/1981 Ferris et al. ..... 446/289
4,282,622 A * 8/1981 Rosendall et al. ..... 15/41.1
4,357,727 A * 11/1982 McDowell ..... 15/41.1
4,624,025 A * 11/1986 Kaulig et al. ..... 15/41.1
5,666,689 A * 9/1997 Andersen ..... 15/384
5,920,939 A * 7/1999 Worwag ..... 15/41.1

FOREIGN PATENT DOCUMENTS

| | | |
|---|---|---|
| CA | 0453063 | * 11/1948 |
| FR | 677024 | * 3/1930 |
| GB | 0000230 | * 1/1871 |
| IT | 599633 | * 11/1959 |

* cited by examiner

*Primary Examiner*—Randall Chin
(74) *Attorney, Agent, or Firm*—Fredrikson & Byron, P.A.

(57) ABSTRACT

A sweeping appliance having a housing having dirt receiving enclosure. A slot-like opening is formed in the underside of the housing. An elongate rotary brush having a plurality of bristles is located towards the front of the sweeping appliance. Front and rear wheels support the housing. A lower regions of the housing is bent to provide a ramp up which particles of dust are swept. A deflector is provided adjacent the brush and extending into the bristles at an angular distance. The deflector halts the progress of the bristles until the brush forces the bristles forward of the deflector, the resilience of the bristles causing them to spring forward. The bristles strike the ground at speed where they impact particles of dirt and force them up the ramp and into the internal enclosure.

20 Claims, 2 Drawing Sheets

(a)

SWEEPING APPLIANCE

BACKGROUND OF THE INVENTION

The present invention relates to a carpet sweeping appliance of the type particularly used to clean floors and carpets and commonly referred to as a "carpet sweeper" although finding applicability in the sweeping of dirt from a variety of other surfaces.

Conventional carpet sweepers comprise a housing which supports a pair of rollers or pairing of wheels and a bristle-carrying rotary brush. The housing is formed with an elongate slot adjacent the brush, leading to an internal dirt-receiving enclosure. The brush is arranged so that the bristles pass over the surface on which the sweeper is resting so that as the brush rotates particles of dirt are swept into the enclosure. In a very common form the brush has the form of a bristle carrying drum which is mechanically linked to the wheels or rollers so that as the carpet sweeper is pushed across the ground the wheels rotate and in turn rotate the brush. In the case of a brush which rotates in the same manner [sense] as a ground supporting roller or wheel, it is also necessary that the brush rotate at a speed faster than the speed at which the carpet sweeper is being pushed across the ground, so as to impart movement to the particles of dirt. This is typically achieved by forming the wheels of a smaller diameter than the bristle-carrying drum, or by using a speed-increasing gear mechanism to link the wheels and the brush. Other arrangements may be used to drive the brush in a reverse direction using a gear mechanism.

In yet another form, the brush may be motor driven, generally by a simple electric motor, in which case the motor is connected to the brush by a speed reducing gear train.

SUMMARY OF THE INVENTION

The present invention provides a sweeping appliance having an outer housing defining an internal dirt receiving enclosure. A slot-like opening is formed in the underside of the housing. An elongate rotary brush having a plurality of resilient bristles is located towards the front of the carpet sweeper, within the slot-like opening. The housing is supported on front and rear pairs of wheels. A lower region of the housing is bent down to provide a ramp up which particles of dust are swept. A deflector is provided on the forward facing side of the brush and extends rearwardly into the space defined by the bristles. The deflector halts the progress of the bristles until the brush rotates sufficiently to force the bristles forward of the deflector, the resilience of the bristles causing them to spring forward in a flicking action. The outer end of the bristles strike the ground at speed where they impact particles of dirt and force them up the ramp and into the internal enclosure.

The structure of the sweeping appliance enables it to impart very rapid movement to the bristles, and thereby rapid movement to the particles of dirt being swept up into the sweeping appliance and in an extremely simple yet effective manner.

Alternatively of front and rear wheels, any roller means such as rollers of greater axial extent than simple wheels may be used. In any event, the wheels or rollers engage the surface to be cleaned. The rotary brush may be coaxial with and directly connected to the first pair of wheels, thereby avoiding the need for any more complex drive arrangements.

The deflector may be a blade-like edge or member unitarily formed with or joined to the housing. The deflector is preferably disposed to engage the bristles so that they move through an angular distance of about 90° as they spring past the deflector. However, considerable variation of the precise angle is still possible whilst yielding effective results.

The rotary brush may comprise a central member from which the bristles radially extend.

BRIEF DESCRIPTION OF THE DRAWINGS

An embodiment of the invention is now described, by way of example only, with reference to the following drawings in which.

DETAILED DESCRIPTION OF THE PREFERRED EMBODIMENT

Figure 1:
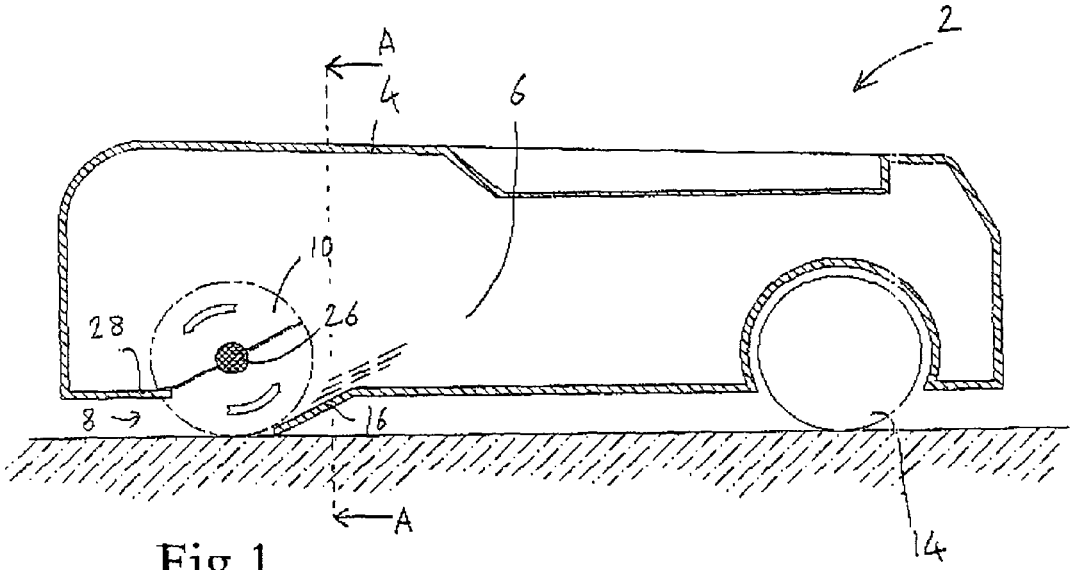
FIG. 1 is a cross-sectional side view of a sweeping appliance according to an embodiment of the invention.

Turning to the drawings, FIG. 1 shows the sweeping appliance in the form of a carpet sweeper generally designated 2 from the side in a part cut away view.

The carpet sweeper 2 has an outer housing 4 defining an internal dirt receiving enclosure 6. A slot-like opening 8, also referred to as a dirt receiving opening, is formed in the underside of the housing 4. For the carpet sweeper to be used for cleaning a floor a long handle (not shown) will be provided preferably pivotably connected to the housing 4. Alternatively, if the carpet sweeper is intended for use in cleaning a table top, for example for sweeping up crumbs of food, the housing 4 may have no handle and instead may have adaptations allowing it to be readily grasped by a user, such as finger grips moulded in the housing 4. Indeed, although the expression carpet sweeper is utilised, the expression should be construed broadly to cover cleaning devices of similar construction whether intended for cleaning carpets, hard floors, table tops or any other surface.

Located towards the front of the carpet sweeper so as to lie within the opening 8 is an elongate rotary brush 10. The brush 10 is mounted on the housing 4 so as to be rotatable about its axis. More specifically, in one embodiment, opposite ends of the brush 10 are supported on a front pair of wheels 12. The brush 10 may, thus, be coaxial with and connected to the pair of wheels 12 to rotate therewith. Alternatively, the wheels 12 may be rollers of greater axial extent than simple wheels or any other roller means. The wheels 12 are themselves rotatably supported on the housing 4. Note that the wheels 12 are not shown in FIG. 1 as in side view their position appears essentially the same as the brush 10. The wheels 12 are therefore omitted to allow the brush 10 to be seen more clearly.

A rear pair of wheels 14 are also mounted on the housing 4. As with the front wheels 12, the rear wheels 14 may be rollers of greater axial extent than simple wheels or any other roller means. The carpet sweeper is thus supported on the front and rear pairs of wheels or rollers 12, 14.

Figure 2:
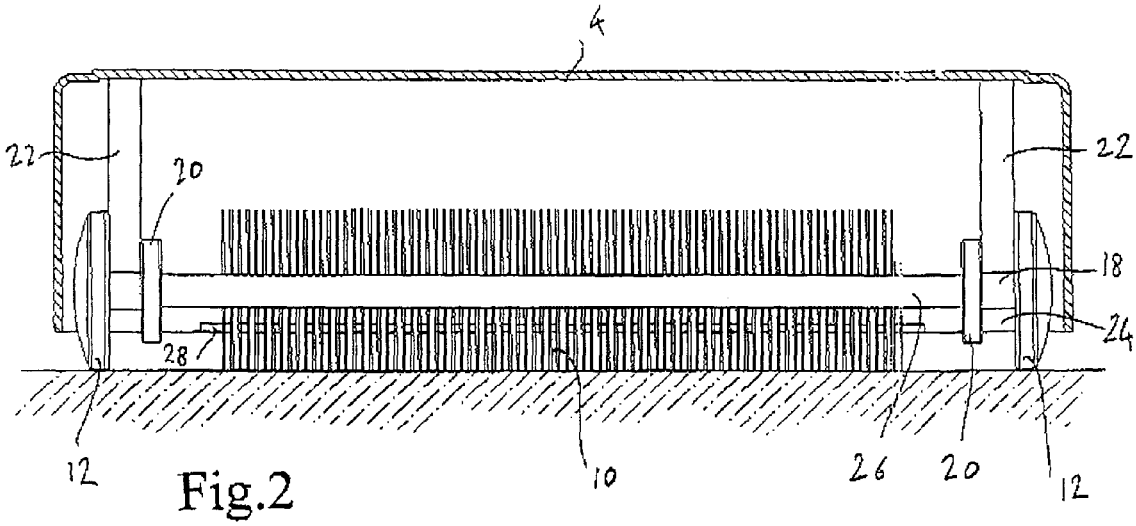
FIG. 2 is a lateral cross-sectional view of the sweeping appliance along the line A—A of FIG. 1.

As can be seen in FIG. 1, a lower region of the housing 4 adjacent the opening 8 is configured to contact the surface to be cleaned. In the embodiment shown, the lower region of the housing 4 is bent down to provide a ramp 16 up which particles of dirt are swept during use, in the manner of a dustpan. As can be seen in FIG. 2, the front wheels 12 are provided with inwardly directed shaft portions 18 with internally located flanges 20, thereby defining a region between the wheels 12 and flanges 20. The housing 4 carries a pair of supports 22 having lower opposed fingers 24 defining a narrow opening therebetween of dimension sufficient to allow the region between wheels 12 and flanges 20 to be snap-fitted therein, assisted by a small degree of resilience of the fingers 24. It will be appreciated however that a wide variety of other constructions for supporting the wheels or rollers and brush may be readily utilised.

Further details of the brush are now described. As illustrated in FIG. 2, the brush 10 comprises a large number of radially extending resilient bristles secured to a central support 26. (In FIG. 1 only a pair of opposed bristles are shown, for reasons of clarity). The central support 26 may conveniently be in the form of a central rod or drum having a plurality of openings from which the bristles or clumps of bristles protrude. Alternatively, a pair of tightly twisted wires might be used with the bristles extending from between the wires. The skilled person will appreciate however that a wide variety of techniques for securing bristles to a central support may be utilised.

On the forward facing side of the brush 10 (the left side as shown in FIG. 1) there is arranged a deflector 28 which protrudes rearwardly a short distance into the space defined by the bristles. The deflector 28 may be in the form of a portion formed unitarily with the housing 4 or may be in the form of blade-like member secured on the housing 4. The deflector 28 is preferably positioned below the axis of the brush 10. In use, a number of bristles stack up behind the deflector 28 before "flicking" past the deflector 28 in the manner as now discussed.

Figure 3:
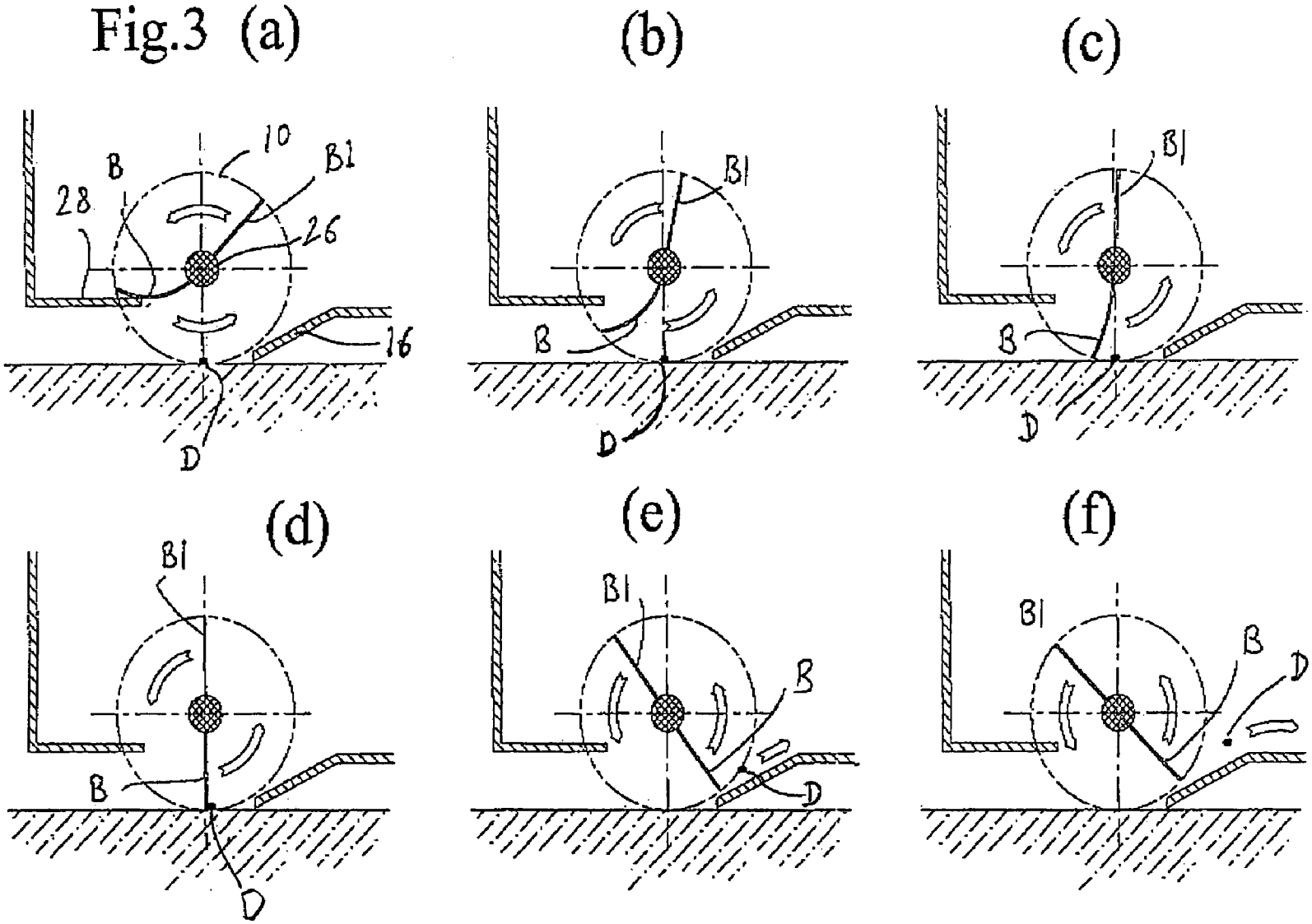
FIGS. 3(*a*), (*b*), (*c*), (*d*), (*e*) and (*f*) are schematic views of the brush of the sweeping appliance showing progressive movement of a single bristle to illustrate the sweeping action.

FIGS. 3(*a*) to (*e*) illustrate the movement of an opposed pair of bristles, with all the other bristles not shown for reasons of clarity. As the brush 10 rotates on rotation of the rollers 12, the outer end of the bristle B abuts the deflector 28, the deflector acting to halt the forward progress of the bristle B whilst the brush 10 rotates through a defined angle, the bristle B adopting the curved shape shown in FIG. 3(*a*). As the brush 10 rotates further, at a point illustrated in FIG. 3(*b*), the return force provided by the resilience of the bristle B is sufficient to bend the end of the bristle B past the deflector 28 in a very rapid "flicking" action. The outer end of the bristle B strikes the ground at speed (FIGS. 3(*c*) and (*d*)) where it impacts a particle of dirt (indicated D) at considerable speed, forcing the particle of dirt D up the ramp 16 and into the internal enclosure 6 (FIGS. 3(*e*) and (*f*)). It will be seen with reference to the opposite bristle BI that between the start of the "flicking" action and the "follow through" of the bristle B the brush 10 has rotated through an angle of about 90°.

The movement of the bristle B required to effectively move the dirt particle D is not dissimilar to the effective striking of a golf ball by a golf club, requiring that the dirt particle be hit at speed and imparted appropriate lift. The deflector 28 is able to do this in a very simple yet effective manner. The precise movement of any particular bristle is affected by the length and diameter of the bristles, its elasticity and by hysteresis effects. In practice, the deflector 28 stores a number of bent bristles behind it such that immediately in front of the deflector 28 there is a void which is free of bristles and through which bristles flicking past the deflector 28 rapidly move on their travels between the positions of FIGS. 3(*a*) to (*e*).

Although the front wheels 12 of the illustrated embodiment directly drive the brush 10, the sweeping device may alternatively be configured such that the brush 10 is indirectly driven through a mechanical linkage such as a gear mechanism. Alternatively, a simple motor may be provided to drive the brush 10.

The invention claimed is:

1. A sweeping appliance comprising a housing having a dirt receiving opening, roller means on which the housing is supported and a rotary brush having a plurality of resilient bristles, a lowermost region of the brush touching a surface to be cleaned, wherein deflecting means are arranged adjacent the brush and extending into the bristles at an angular distance behind the point at which the bristles touch the surface to be cleaned relative to a direction of rotation, so that as the brush rotates, the bristles are held behind the deflecting means until their resilience causes them to spring past said deflecting means in a flicking movement during which the bristles strike said surface to be cleaned.

2. A sweeping appliance according to claim 1 wherein the roller means comprise a first pair of wheels and a second pair of wheels all engaging the surface to be cleaned.

3. A sweeping appliance according to claim 2 wherein the rotary brush is coaxial with and connected to the first pair of wheels to rotate therewith.

4. A sweeping appliance according to claim 1 wherein the deflecting means is a blade-like edge or member unitarily formed with or joined to the housing.

5. A sweeping appliance according to claim 4 wherein the blade-like edge or member is disposed to engage the bristles so that they move through an angular distance of about 90° as they spring past said blade-like edge or member.

6. A sweeping appliance according to claim 1 wherein the rotary brush comprises a central member from which the bristles radially extend.

7. A sweeping appliance comprising:

a housing having a forwardly facing edge and a rearwardly facing edge and defining a dirt receiving enclosure, a dirt receiving opening being formed in the housing and leading to the dirt receiving enclosure;

rollers supporting the housing;

a rotary brush provided proximate the dirt receiving opening having a plurality of resilient bristles with a lower region of the rotary brush touching a surface to be cleaned;

a deflector provided adjacent the brush on a forwardly-facing side thereof and extending rearwardly into the bristles at an angular distance from the point at which the bristles touch the surface to be cleaned, the deflector being configured to halt the progress of the bristles until the brush rotates sufficiently to force the bristles past the deflector, such that the resilience of the bristles causing them to spring past the deflector in a flicking movement during which the bristles strike the surface to be cleaned.

8. The sweeping appliance of claim 7, wherein the rollers comprise a first pair of wheels positioned at a forward portion of the housing and a second pair of wheels positioned at a rearward portion of the housing, the first and second pair of wheels engaging the surface to be cleaned.

9. The sweeping appliance of claim 8, wherein the rotary brush is coaxial with and connected to the first pair of wheels to rotate therewith.

10. The sweeping appliance of claim 7, wherein the deflector is a blade-like member.

11. The sweeping appliance of claim 10, wherein the blade-like member is unitarily formed with the housing.

12. The sweeping appliance of claim 10, wherein the blade-like member is joined to the housing.

13. The sweeping appliance of claim 10, wherein the blade-like member is disposed to engage the bristles so that the bristles move through an angular distance of approximately 90° as they spring past the deflector.

14. The sweeping appliance of claim 7, wherein the rotary brush comprises a central member from which the bristles radially extend.

15. The sweeping appliance of claim 7, wherein a lower region of the housing is configured to contact the surface to be cleaned, the lower region being bent downwards to form a ramp.

16. A sweeping appliance comprising:

a housing having a dirt receiving opening and a ramp adjacent the opening;

rollers supporting the housing;

a rotary brush provided proximate the dirt receiving opening and having a plurality of resilient bristles, the rotary brush having a lower region wherein the bristles touch a surface to be cleaned;

a deflector provided adjacent the brush and at an angular position from the point at which the bristles touch the surface to be cleaned, the deflector being configured to halt the progress of the bristles until the brush rotates sufficiently to force the bristles past the deflector, such that resilience of the bristles causes them to spring past the deflector over the surface to be cleaned, the bristles striking dirt particles on said surface and then sweeping the dirt particles up the ramp.

17. A sweeping appliance according to claim 16 wherein the rollers comprises a first pair of wheels and a second pair of wheels all engaging the surface to be cleaned.

18. A sweeping appliance according to claim 17 wherein the rotary brush is coaxial with and connected to the first pair of wheels to rotate therewith.

19. A sweeping appliance according to claim 16 wherein the deflector is a blade-like edge or member unitarily formed with or joined to the housing.

20. A sweeping appliance according to claim 16 wherein the rotary brush comprises a central member from which the bristles radially extend.

* * * * *